US006365562B1

(12) United States Patent
Fischer et al.

(10) Patent No.: US 6,365,562 B1
(45) Date of Patent: Apr. 2, 2002

(54) LAUNDRY DETERGENTS AND CLEANERS COMPRISING BLEACHING-ACTIVE DENDRIMER LIGANDS AND METAL COMPLEXES THEREOF

(75) Inventors: Claudia Fischer, Eschborn; Nicole Reichardt, Flörsheim; Jörg Issberner, Krefeld, all of (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/839,732

(22) Filed: Apr. 20, 2001

(30) Foreign Application Priority Data

Apr. 20, 2000 (DE) ..... 100 19 877

(51) Int. Cl.[7] ..... C11D 3/26; C11D 3/39; C11D 3/395

(52) U.S. Cl. ..... 510/311; 510/303; 510/312; 510/372; 510/376; 510/499; 510/506; 564/307; 564/463; 556/45; 556/136; 556/137

(58) Field of Search ..... 510/303, 311, 510/312, 372, 376, 499, 506; 556/45, 136, 137; 564/307, 463

(56) References Cited

U.S. PATENT DOCUMENTS

| | | | | |
|---|---|---|---|---|
| 3,929,678 A | | 12/1975 | Laughlin et al. | 510/349 |
| 4,087,369 A | | 5/1978 | Wevers | 510/312 |
| 4,144,226 A | | 3/1979 | Crutchfield et al. | 525/401 |
| 4,146,495 A | | 3/1979 | Crutchfield et al. | 510/476 |
| 4,583,217 A | | 4/1986 | Kittel | 370/208 |
| 5,248,826 A | * | 9/1993 | Sasaki et al. | 564/307 |
| 5,847,190 A | | 12/1998 | Paulus et al. | 558/302 |
| 6,180,590 B1 | | 1/2001 | Huff et al. | 510/499 |
| 6,225,274 B1 | | 5/2001 | Nitsch et al. | 510/314 |

FOREIGN PATENT DOCUMENTS

| | | |
|---|---|---|
| CA | 1102966 | 12/1978 |
| DE | 196 11 977 | 10/1997 |
| DE | 196 21 510 | 12/1997 |
| DE | 196 49 375 | 6/1998 |
| DE | 198 09 713 | 7/1999 |
| EP | 0 062 523 | 10/1982 |
| EP | 0 101 634 | 2/1984 |
| EP | 0 240 057 | 10/1987 |
| EP | 0 241 962 | 10/1987 |
| EP | 0 458 397 | 11/1991 |
| GB | 1 561 333 | 2/1980 |
| WO | WO 96/06154 | 2/1996 |

OTHER PUBLICATIONS

R. Moors, Dendrimere Polyamine, Chem. Ber. 126, p. 2133–2135, 1993.
English Translation of the Abstract Of DE 198 09 713 7/99.
English Translation of the Abstract Of DE 196 21 510 12/96.
English Translation of the Abstract Of DE 196 49 375 5/01.
English Translation of the Abstract Of EP 0 101 634 4/86.

* cited by examiner

*Primary Examiner*—Gregory DelCotto
(74) *Attorney, Agent, or Firm*—Richard P. Silverman

(57) ABSTRACT

Laundry detergents and cleaners which, in addition to a peroxide compound, comprise a compound of the formula $$(R^1R^1)N—X—N(R^1R^1) \quad (I)$$

or metal complexes thereof, where X and $R^1$ have the meanings listed in the description, are claimed.

6 Claims, No Drawings

LAUNDRY DETERGENTS AND CLEANERS COMPRISING BLEACHING-ACTIVE DENDRIMER LIGANDS AND METAL COMPLEXES THEREOF

BACKGROUND OF THE INVENTION

It is known that the bleaching power of peroxide bleaches, such as hydrogen peroxide, perborates, percarbonates, persilicates and perphosphates, in laundry detergents and cleaners, and thus the efficiency of these bleaches for the removal of tea, coffee, fruit or red wine stains only fully develops at relatively high temperatures of significantly more than 60° C. To improve the bleaching action, which is greatly reduced at relatively low temperatures, below 60° C. in particular, it is possible to use compounds to activate the peroxide bleaches. A number of transition metal salts and corresponding complexes with mostly chelating compounds have been proposed for this purpose, although the effectiveness of a metal or of a specific combination of transition metal and complex ligand cannot be predicted.

A large number of specifications, for example WO 96/06154 and EP 458 397, claim metal complexes with a high activation potential. DE 1 980 9713 describes transition metal complexes with polyamidoamine dendrimer ligand systems. It is an object to find bleaching catalysts which have a high oxidizing and bleaching capacity and which also harm the colors of dyed textiles or surfaces, and the textile fibers as little as possible.

A dendritic polyamine and its cobalt complex are described in Chem. Ber. 1993, pp. 2133–2135. DE-A-196 21 510 describes dendrimers with planar-chiral or axial-chiral end groups.

SUMMARY OF THE INVENTION

We have now found that transition metal complexes with dendrimers of the polyalkyleneimine type improve the bleaching action of peroxygen compounds during the bleaching of colored soilings both on textiles and on hard surfaces, without harming colors and fibers. Moreover, we have found that the use of dendrimers which are not bonded to form complexes with transition metals in laundry detergents and cleaners enhance the oxidizing and bleaching capacity of the compositions in aqueous solution.

DESCRIPTION OF THE PREFERRED EMBODIMENTS

The invention provides laundry detergents and cleaners comprising a compound of the formula $$(R^1R^1)N—X—N(R^1R^1) \quad (I)$$

in which $R^1$ is a group of the formula $(R^2R^3)N—(CH_2)_n—$, $R^2$ and $R^3$ are in each case a group of the formula $(R^4R^5)N—(CH_2)_n—$, n is the numbers 2 or 3, or $R^2$ and $R^3$ together are the group of the formula A or $R^2$ is hydrogen and $R^3$ is a group of the formula

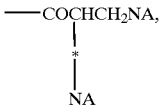

$R^4$ and $R^5$ are in each case a group of the formula $(R^6R^7)—N—(CH_2)_n—$, n is the numbers 2 or 3, or $R^4$ and $R^5$ together are the group of the formula A or $R^4$ is hydrogen and $R^5$ is a group of the formula

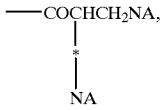

$R^6$ and $R^7$ are in each case a group of the formula $(R^8R^9)N—(CH_2)_n—$, n is the numbers 2 or 3, or $R^6$ and $R^7$ together are the group of the formula A or $R^6$ is hydrogen and $R^7$ is a group of the formula

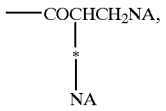

$R^8$ and $R^9$ together are the group of the formula A or $R^8$ is hydrogen and $R^9$ is a group of the formula

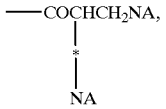

A is a group of the formula

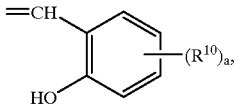

in which a is an integer from 1 to 4, and $R^{10}$ is hydrogen, $C_1$–$C_{30}$-alkyl, cycloalkyl or aryl radicals, $C_1$–$C_4$-alkoxy groups, substituted or unsubstituted amino or ammonium groups, halogen atoms, sulfo groups, carboxyl groups or groups of the formula $—(CH_2)_r—COOH$, $—(CH_2)_r—SO_3H$, $—(CH_2)_r—PO_3H_2$, $—(CH_2)_r—OH$, where r is an integer from 0 to 4, and said acid groups may also be present in salt form, and X is a group of the formulae $—(CH_2)_n—$, $—(CH_2)_3—NR^{11}—(CH_2)_3—$, $—(CH_2)_2—NR^{11}—(CH_2)_2—$, $C_2$–$C_{20}$-alkylene, $—(CH_2)_l—[O—(CH_2)_k]_m—O—CH_2)_l)—$, n is a number from 2 to 20, l and k are a number from 2 to 6, m is a number from 1 to 40, $R^{11}$ is $C_1$–$C_{20}$-alkyl, $C_2$–$C_{20}$-dialkylamino-$C_2$–$C_{10}$-alkyl, $C_1$–$C_{10}$-alkoxy-$C_2$–$C_{10}$-alkyl, $C_2$–$C_{20}$-hydroxyalkyl, $C_3$–$C_{12}$-cycloalkyl, $C_4$–$C_{20}$-cycloalkyl-alkyl, $C_2$–$C_{20}$-alkenyl, $C_4$–$C_{30}$-dialkylamino-alkenyl, $C_3$–$C_{30}$-alkoxyalkenyl, $C_3$–$C_{20}$-hydroxyalkenyl, $C_5$–$C_{20}$-cycloalkyl-alkenyl, [lacuna] optionally by $C_1$–$C_8$-alkyl, $C_2$–$C_8$-dialkylamino, $C_1$–$C_8$-alkoxy, hydroxyl, $C_3$–$C_8$-cycloalkyl, $C_4$–$C_{12}$-cycloalkyl-alkyl, or together are an alkylene chain optionally interrupted by nitrogen or oxygen, such as ethylene oxide, propylene oxide, butylene oxide or $—CH_2—CH(CH_3)—O—$.

The invention further provides laundry detergents and cleaners comprising complexes of the above-defined compounds with cobalt, manganese, iron, ruthenium, vanadium, molybdenum or tungsten. Preference is given to manganese complexes. These compounds and the corresponding metal complexes are suitable as bleaching and oxidation catalysts in the case of peroxygen compounds, in particular in laundry detergents and cleaners which comprise peroxygen compounds, for example universal laundry detergents or machine dishwashing detergents. These catalysts improve the oxidizing and bleaching action of the inorganic peroxygen compounds at temperatures below 80° C., in particular in the temperature range from 15 to 45° C. with simultaneous reduction in color and textile fiber damage. Moreover, the compounds defined above and metal complexes thereof can also be used in the bleaching of paper.

The preparation of the polysalene dendrimers of the formula I has been carried out by a method described in the specialist literature (R. Moors, F. Vögtle, Chem. Ber. 1993, 126, 2133–2135). The initiator core used here is ethylenediamine, which is converted by a Michael Addition with acrylonitrile. The terminal nitrile groups are reduced to give the amine, as a result of which a further addition of acrylonitrile is made possible. By repeating this synthesis frequency, the number of functionalities doubles. In each of these synthesis stages, the amino groups can be reacted with salicylaldehyde, giving compounds of the formula I containing the group A. Reaction of the amino groups with a derivative of ∀,∃-diaminopropionic acid and subsequent reaction with salicylaldehyde gives compounds of the formula I which contain groups of the formula —COCHNA—$CH_2$NA.

The products are formed as yellow solids or oils. The complexation with metal cations can take place in three different ways. In the first method, the ligand is prepared as described by Moors and Vögtle. This is then followed, in a suitable solvent, e.g. chloroform, methylene chloride, ethanol, methanol, dimethylformamide, water, dimethyl sulfoxide or mixtures thereof, by the reaction with the metal cation, for example to give the dendritic complex.

In a second embodiment, salicylaldehyde, dendritic polyamine and metal salt are combined in a one-pot reaction in a suitable solvent, e.g. chloroform, methylene chloride, ethanol, methanol, dimethylformamide, water, dimethyl sulfoxide or mixtures thereof, forming the catalysts according to the invention. In the third embodiment, the metal-free polysalene dendrimer can be used. In this case, the dendrimer takes up the metal cations present in the water during use and acts as catalyst. It is also possible to use the metal-free polysalene dendrimer, optionally incorporated into a matrix, and a suitable metal salt separately in a laundry detergent formulation. By dissolving the laundry detergent formulation, the reactants are able to meet and form the catalyst. Preference is given to the compounds of the formula I which contain the groups A. Particular preference is given to the compounds and the metal complexes thereof 4-cascade:ethylenediamine [4]:(1-azabutylidene):2-methinephenol, 8-cascade:ethylenediamine[4]:(1-azabutylidene)$^2$:2-methinephenol, 16-cascade:ethylenediamine[4]:(1-azabutylidene)$^3$:2-methinephenol, 32-cascade:ethylenediamine[4]:(1-azabutylidene)$^4$:2-methinephenol.

Where appropriate, the dendrimer nomenclature proposed by Newkome has been used for dendritic compounds [G. R. Newkome, C. Morefield, F. Vögtle in Dendritic Macromolecules, VCH, Weinheim 1996].

Such dendrimers can be loaded with stoichiometrically different amounts of transition metal. In the maximum case, all nitrogen atoms of the dendrimer are saturated with transition metal.

In addition to the peripheral N atoms, internal nitrogen atoms of the dendrimer can also form complexes, and the resulting complex can have a catalytic action. The total number of peripheral and internal nitrogen atoms are:

| Generation: | 0 | 1 | 2 | 3 | 4 | 5 | ... |
|---|---|---|---|---|---|---|---|
| Number of N atoms: | 2 | 6 | 14 | 30 | 62 | 126 | |

The transition metals in the complexes to be used according to the invention can have oxidation states in the range from +II to +V, depending on the metal. Manganese, cobalt and molybdenum are the preferred transition metals. Polynuclear systems with mixed oxidation numbers and/or two or more different transition metals are also possible.

Apart from the dendrimer ligand, the complex compounds to be used according to the invention can also carry further ligands which usually have a simpler structure, in particular neutral or mono- or polyvalent anionic ligands. Suitable ligands are, for example, water, nitrate, acetate, formate, citrate, perchlorate and the halides, such as chloride, bromide and iodide, and complex anions, such as hexafluorophosphate. The anionic ligands serve to balance the charge between transition metal center and the ligand system. The presence of oxo ligands, peroxo ligands and imino ligands is also possible. These additional ligands can also act as bridges, meaning that oligomeric polynuclear complexes with at least one dendrimer ligand arise.

The transition metal dendrimer complexes described, but also the dendrimers as such are highly suitable as bleaching and oxidation catalysts, in particular in laundry detergent and cleaners for the cleaning of textiles and also of hard surfaces, in particular of dishes, and in the bleaching of textiles and paper. Particular mention is to be made here of textile detergents in the form of powder laundry detergents or as liquid formulations and dishwashing detergent. An advantage of the bleach catalysts according to the invention is their stability toward hydrolysis and oxidation, and their catalytic action even at low temperatures. In such formulations, they improve not only the bleaching action of hydrogen peroxide, but also that of organic and inorganic peroxy compounds.

Accordingly, the present invention further provides a process for bleaching soiled substrates, in which the soiled substrate is brought into contact in an aqueous bleaching liquor with peroxy compounds and an effective amount of one or more of the compounds of the formula I, or of the corresponding metal complexes as bleach catalysts. As well as purely aqueous solutions, mixtures of water and suitable organic solvents are also suitable as reaction medium. The amounts of peroxygen compounds used are generally chosen such that between 10 ppm and 10% of active oxygen, preferably between 50 ppm and 5000 ppm of active oxygen, are present in the solutions. The amount of compounds of the formula I according to the invention, or metal complexes thereof, used also depends on the intended use. Depending on the desired degree of activation, it is used in amounts such that 0.01 mmol to 25 mmol, preferably 0.1 mmol to 2 mmol, of complex are used per mole of peroxygen compound, although in specific cases it is possible to exceed or fall below these limits.

The laundry detergent and cleaners according to the invention thus comprise these bleach catalysts in the amounts by weight of from 0.0001 to 0.5% by weight, in particular 0.00025 to 0.25% by weight, especially 0.0005 to 0.1% by weight, based on the weight of the formulations.

These laundry detergents and cleaners, which may be in the form of pulverulent, granular or tablet-shaped solids, homogeneous solutions or suspensions, can, in principle, apart from the bleaching catalysts used according to the invention, comprise all known ingredients customary in such compositions, such as peroxygen compounds, bleach activators, further conventional bleaching catalysts, surfactants, builders, water-miscible organic solvents, enzymes, sequestering agents, electrolytes, pH regulators and further auxiliaries, such as silver corrosion inhibitors, foam regulators, thickeners, preservatives, pearlizing agents and emulsifiers, and colorants and fragrances.

Suitable peroxygen compounds are, in particular, organic peracids or peracidic salts of organic acid. Examples thereof are peroxynaphthoic acid, peroxylauric acid, peroxystearic acid, N,N-phthaloylaminoperoxycaproic acid, perbenzoic acid, diperdodecanedioic acid, 1,12-diperoxydodecanedioic acid, 1,9-diperoxyazelaic acid, diperoxysebacic acid, diperoxyisophthalic acid, 2-decyldiperoxybutane-1,4-dioic acid and 4,4'-sulfonylbisperoxybenzoic acid. Also suitable are hydrogen peroxide and compounds which release hydrogen peroxide under the washing and cleaning conditions, such as alkali metal peroxides, organic peroxides, such as urea/hydrogen peroxide adducts, and inorganic persalts, such as the alkali metal perborates, percarbonates, perphosphates, persilicates and persulfates. Particular preference is given to sodium perborate tetrahydrate and, in particular, sodium perborate monohydrate. Preference is given to sodium perborate monohydrate because of its good storage stability and its good solubility in water. Sodium percarbonate may be preferred for environmental protection reasons. Alkyl hydroperoxides are a further suitable group of peroxide compounds. Examples of these substances are cumene hydroperoxide and butyl hydroperoxide. Also suitable as peroxy compounds are inorganic peroxy acid salts, e.g. potassium monopersulfate. Mixtures of two or more of these compounds are likewise suitable.

The laundry detergent and cleaner formulations according to the invention usually comprise 1 to 30% by weight, in particular 2 to 25% by weight, of peroxy compounds.

The addition of small amounts of known bleach stabilizers such as, for example, phosphonates, borates, metaborates and metasilicates, and magnesium salts, such as magnesium sulfate, may be appropriate.

In addition to the bleaching catalysts according to the invention, known bleach activators which, under perhydrolysis conditions, produce aliphatic percarboxylic acids having, preferably, 1 to 10 carbon atoms, in particular 2 to 4 carbon atoms and/or optionally substituted perbenzoic acid, may also be used. Suitable substances are those which carry O- and/or N-acyl groups of said number of carbon atoms and/or optionally substituted benzoyl groups. Preference is given to polyacylated alkylenediamines, in particular tetraacetylethylenediamine (TAED), acylated triazine derivates, in particular 1,5-diacetyl-2,4-dioxohexahydro-1,3,5-triazine (DADHT), acylated glycolu riles, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran, sodium nonanoyloxybenzenesulfonate, sodium isononanoyloxybenzenesulfonate, sodium 4-benzoyloxybenzenesulfonate, sodium trimethylhexanoyloxy-benzenesulfonate, lactones, acylals, carboxamides, acyllactams, acylated ureas and oxamides, N-acylated hydantoins, for example 1-phenyl-3-acetylhydantoin, hydrazides, triazoles, hydrotriazines, urazoles, diketopiperazides, sulfurylamides and/or N-acylated lactams, for example N-benzoylcaprolactam, but also quaternary nitrile compounds, for example quaternary trialkylammonium nitrile salts, in particular the cyanomethyltrimethylammonium salt, but also heterocyclically substituted quaternary nitrile compounds and the enol esters known from German Patent Applications DE 196 16 693 and DE 196 16 767, and acylated sorbitol and mannitol or the mixtures thereof described in EP 0 525 239 (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone.

Such bleach activators are present in the customary quantitative range, preferably in amounts of from 1 to 10% by weight, in particular 2 to 8% by weight, based on the total composition.

In addition to the conventional bleach activators listed above, or instead of them, it is also possible for sulfoneimines and/or further bleach-enhancing transition metal salts or transition metal complexes to be present. Suitable transition metal compounds include, in particular, the manganese, iron, cobalt, ruthenium or molybdenum salene complexes known from DE 195 29 905 and DE 196 05 688.

As surface-active agents, the laundry detergents and cleaners according to the invention can comprise anionic surfactants in amounts of from approximately 1 to 50% by weight, based on the total amount of all surfactants. Preferred anionic surfactants are $C_8$–$C_{20}$-fatty acid alpha-methyl ester sulfonates, alkyl ether sulfates and secondary alkanesulfonates. The alkyl ether sulfates used in the compositions according to the invention are water-soluble salts or acids of the formula $RO(A)_mSO_3M$, in which R is an unsubstituted $C_{10}$–$C_{24}$-alkyl or $C_{10}$–$C_{24}$-hydroxyalkyl radical, preferably a $C_{12}$–$C_{20}$-alkyl or $C_{12}$–$C_{20}$-hydroxyalkyl radical, particularly preferably $C_{12}$–$C_{18}$-alkyl or $C_{12}$–$C_{18}$-hydroxyalkyl radical. "A" is an ethoxy or propoxy unit, m is a number greater than 0, preferably between 0.5 and about 6, particularly preferably between about 0.5 and about 3, and M is a hydrogen atom or a cation, such as, for example, a metal cation (e.g. sodium, potassium, lithium, calcium, magnesium, etc.), ammonium or a substituted ammonium cation. Specific examples of substituted ammonium cations are methyl, dimethyl, trimethylammonium and quaternary ammonium cations, such as tetramethylammonium and dimethylpiperidinium cations, and those derived from alkylamines, such as ethylamine, diethylamine, triethylamine. Examples of these alkyl ether sulfates which may be mentioned are $C_{12}$–$C_{18}$-alkyl polyethoxylate(1.0) sulfate, ($C_{12}$–$C_{18}$E(1.0)M), $C_{12}$–$C_{18}$-alkyl polyethoxylate(2.25) sulfate ($C_{12}$–$C_{18}$E(2.25)M), $C_{12}$–$C_{18}$-alkyl polyethoxylate(3.0) sulfate ($C_{12}$–$C_{18}$E(3.0)M), $C_{12}$–$C_{18}$-alkyl polyethoxylate (4.0) sulfate ($C_{12}$–$C_{18}$E(4.0)M), where E is an ethoxy unit.

In the case of the secondary alkanesulfonates, the alkyl group can either be saturated or unsaturated, branched or linear and optionally substituted by a hydroxyl group. The sulfo group is randomly distributed over the entire carbon chain, where the primary methyl groups on the start of the chain and on the end of the chain do not have sulfonate groups. Preferred secondary alkanesulfonates contain linear alkyl chains having 9 to 25 carbon atoms, preferably from 10 to 20 carbon atoms and particularly preferably 13 to 17 carbon atoms. The cation is sodium, potassium, ammonium, mono-, di- or triethanolammonium, calcium or magnesium and mixtures thereof. For the sake of simplicity, sodium is preferred as cation.

In addition to or instead of these preferred anionic surfactants, the formulations according to the invention can also comprise other types of anionic surfactants within the limits given above, such as, for example, alkylsulfates, alkylsulfonates, alkylcarboxylates, alkylphosphates and mixtures of said compounds. Suitable cations are, for example, sodium, potassium, calcium or magnesium, and ammonium, substituted ammonium compounds, including mono-, di- or triethanolammonium cations, and mixtures of these cations. The anionic surfactants which are suitable for the present invention have surfactant properties and are water-soluble or water-dispersible.

Here, alkylsulfates are water-soluble salts or acids of the formula $ROSO_3M$, in which R is preferably a $C_{10}$–$C_{24}$-hydrocarbon radical, preferably an alkyl or hydroxyalkyl radical having $C_{10}$–$C_{20}$-alkyl components, particularly preferably a $C_{12}$–$C_{18}$-alkyl or hydroxyalkyl radical. M is hydrogen or a cation, e.g. sodium, potassium, lithium or ammonium or substituted ammonium, e.g. methyl-, dimethyl- and trimethylammonium cations and quaternary ammonium cations, such as tetramethylammonium and dimethylpiperidinium cations and quaternary ammonium cations derived from alkylamines, such as ethylamine, diethylamine, triethylamine and mixtures thereof.

A further suitable anionic surfactant is alkylbenzenesulfonate. The alkyl group can either be saturated or unsaturated, branched or linear and optionally substituted by a hydroxyl group.

The preferred alkylbenzenesulfonates contain linear alkyl chains having 9 to 25 carbon atoms, preferably 10 to 13 carbon atoms, and the cation is sodium, potassium, ammonium, mono-, di- or triethanolammonium, calcium or magnesium and mixtures thereof.

Further suitable anionic surfactants are carboxylates, e.g. fatty acid soaps and comparable surfactants. The soaps can be saturated or unsaturated and can contain various substituents, such as hydroxyl groups or alpha-sulfonate groups. Preference is given to linear saturated or unsaturated hydrocarbon radicals as hydrophobic component in the soaps. The hydrophobic components usually contain 6 to 30 carbon atoms, preferably 10 to 18 carbon atoms. Further anionic surfactants are salts of acylaminocarboxylic acids, which are formed by reacting fatty acid chlorides with sodium sarcosinate in alkaline medium (acyl sarcosinates), and also fatty acid protein condensation products which are obtained by reacting fatty acid chlorides with oligopeptides. The salts of alkylsulfamidocarboxylic acids and the salts of alkyl and alkylaryl ether carboxylic acids also have surfactant character.

Other anionic surfactants which are beneficial for use in cleaners are $C_8$–$C_{24}$ olefinsulfonates, sulfonated polycarboxylic acids prepared by sulfonating the pyrolysis products of alkaline earth metal citrates, as described, for example, in GB 1 082 179, alkyl glycerol sulfates, fatty acyl glycerol sulfates, oleyl glycerol sulfates, alkyl phenol ether sulfates, primary paraffinsulfonates, alkylphosphates, alkyl ether phosphates, isethionates, such as acyl isethionates, N-acyltaurides, alkylsuccinamates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acylsarcosinates, sulfates of alkylpolysaccharides, such as sulfates of alkylglycosides, branched primary alkylsulfates and alkylpolyethoxycarboxylates, such as those of the formula $RO(CH_2CH_2)_kCH_2COOM$, in which R is a $C_8$–$C_{22}$-alkyl, k is a number from 0 to 10 and M is a cation which forms a soluble salt. Resin acids or hydrogenated resin acids, such as rosin or hydrogenated rosin or tall oil resins and tall oil resin acids can likewise be used. Further examples are described in "Surface Active Agents and Detergents" (Vol. I and II, Schwartz, Perry and Berch). A large number of such surfactants are also described in U.S. Pat. No. 3,929,678.

Typical examples of anionic surfactants are also alkyl ether sulfonates, glycerol ether sulfonates, sulfo fatty acids, fatty alcohol ether sulfates, glycerol ether sulfates, hydroxy mixed ether sulfates, fatty acid amide (ether) sulfates, mono- and dialkylsulfosuccinates, mono- and dialkylsulfosuccinamates, sulfotriglycerides, amide soaps, alkyloligoglucosidesulfates, alkylamino sugar sulfates and alkyl (ether) phosphates. If the anionic surfactants contain polyglycol ether chains, they can have a conventional or a narrowed homolog distribution.

In the compositions according to the invention it is possible to use nonionic surfactants, such as fatty acid alkyl ester alkoxylates, alkyl and/or alkenyl oligoglycosides, fatty alcohol polyglycol ethers, alkylphenol polyglycol ethers, fatty acid polyglycol esters, fatty acid amide polyglycol ethers, fatty amine polyglycol ethers, alkoxylated triglycerides, fatty acid glucamides, polyoil fatty acid esters, sugar esters, sorbitan esters and polysorbates and/or alkoxylated fatty alcohols. The proportion of nonionic surfactants overall relative to the total amount of all surfactants in the cleaners according to the invention is generally 1 to 50% by weight.

Furthermore, in the compositions according to the invention it is possible to use cosurfactants from the group consisting of alkylbetaines, alkylamidobetaines, aminopropionates, aminoglycinates, imidazoliniumbetaines and sulfobetaines, amine oxides and fatty acid alkanolamides, particularly the monoethanolamides of palm kernel oil and coconut oil fatty acids or polyhydroxyamides in the amounts from 1 to 50% by weight.

The total amount of surface-active compounds can be up to 50% by weight, preferably 1 to 40% by weight, in particular 4 to 25% by weight, of the overall laundry detergent or cleaner.

Suitable organic and inorganic builders are neutral or, in particular, alkaline salts which can precipitate out calcium ions or form complexes with them. Suitable and particularly ecologically acceptable builder substances are crystalline, layered silicates of the formula $NaMSi_{(x)}O_{(2x+1)}$, where M is sodium or hydrogen, x is a number from 1.9 to 22, preferably from 1.9 to 4 and y is a number from 0 to 33, for example Na SKS-5 ($\alpha$-$Na_2Si_2O_5$), Na SKS-7 ($\beta$-$Na_2Si_2O_5$, natrosilite), Na SKS-9 ($NaHSi_2O_5{*}H_2O$), Na SKS-10 ($NaHSi_2O_3{*}3H_2O$, canemite), Na SKS-11 (t-$Na_2Si_2O_5$) and Na SKS-13 ($NaHSi_2O_5$), but in particular Na SKS-6 ($\delta$-$Na_2Si_2O_5$), and finely crystalline synthetic hydrous zeolites, in particular of the type NaA, which have a calcium-binding capacity in the range from 100 to 200 mg of CaO/g. Zeolites and phyllosilicates can be present in the composition in an amount of up to 20% by weight.

Also suitable are non-neutralized or partially neutralized (co)polymeric polycarboxylic acids. These include the homopolymers of acrylic acid or of methacrylic acid or copolymers thereof with further ethylenically unsaturated monomers, such as, for example, acrolein, dimethylacrylic acid, ethylacrylic acid, vinylacetic acid, allylacetic acid, maleic acid, fumaric acid, itaconic acid, (meth)allylsulfonic acid, vinylsulfonic acid, styrenesulfonic acid, acrylamidomethylpropanesulfonic acid, and monomers containing phosphorus groups, such as, for example, vinylphosphoric acid, allylphosphoric acid and acrylamidomethylpropanephosphoric acid and salts thereof, and hydroxyethyl (meth) acrylate sulfate, allyl alcohol sulfate and allyl alcohol phosphates.

Preferred (co)polymers have an average molar mass from 1000 to 100,000 g/mol, preferably from 2000 to 75,000 g/mol and in particular from 2000 to 35,000 g/mol.

The degree of neutralization of the acid groups is advantageously 0 to 90%, preferably 10 to 80% and in particular 30 to 70%.

Suitable polymers include, in particular, homopolymers of acrylic acid and copolymers of (meth)acrylic acid with maleic acid or maleic anhydride.

Further suitable copolymers are derived from terpolymers which can be obtained by polymerizing from 10 to 70% by weight of monoethylenically unsaturated dicarboxylic acids having 4 to 8 carbon atoms, salts thereof, 20 to 85% by weight of monoethylenically unsaturated monocarboxylic acids having 3 to 10 carbon atoms or salts thereof, 1 to 50% by weight of monounsaturated monomers which, following hydrolysis, release hydroxyl groups at the polymer chain, and 0 to 10% by weight of further, free-radically copolymerizable monomers.

Likewise suitable are graft polymers of monosaccharides, oligosaccharides, polysaccharides and modified polysaccharides, and animal or vegetable proteins.

Preference is given to copolymers of sugars and other polyhydroxy compounds and a monomer mixture of 45 to 96% by weight of monoethylenically unsaturated $C_3$- to $C_{10}$-monocarboxylic acids or mixtures of $C_3$- to $C_{10}$-monocarboxylic acids and/or salts thereof containing monovalent cations, 4 to 55% by weight of monomers containing monoethylenically unsaturated monosulfonic acid groups, monoethylenically unsaturated sulfuric esters, vinylphosphoric esters and/or the salts of these acids containing monovalent cations, and 0 to 30% by weight of water-soluble unsaturated compounds which have been modified with 2 to 50 mol of alkylene oxide per mole of monoethylenically unsaturated compounds.

Further suitable polymers are polyaspartic acid or derivatives thereof in non-neutralized or only partially neutralized form.

Particularly suitable are also graft polymers of acrylic acid, methacrylic acid, maleic acid and further ethylenically unsaturated monomers to salts of polyaspartic acid, as are customarily produced during the above-described hydrolysis of polysuccinimide. In this connection, it is possible to dispense with the otherwise necessary addition of acid for the preparation of the only partially neutralized form of polyaspartic acid. The amount of polyaspartate is usually chosen such that the degree of neutralization of all of the carboxyl groups incorporated in the polymer does not exceed 80%, preferably 60%.

Further builders which can be used are, for example, the percarboxylic acids, preferably used in the form of their sodium salts, such as citric acid, in particular trisodium citrate and trisodium citrate dihydrate, nitrilotriacetic acid and its water-soluble salts; alkali metal salts of carboxymethyloxysuccinic acid, ethylenediaminetetraacetic acid, mono-, dihydroxysuccinic acid, α-hydroxypropionic acid, gluconic acid, mellitic acid, benzopolycarboxylic acids and [lacuna] as disclosed in U.S. Pat. Nos. 4,144,226 and 4,146,495.

Phosphate-containing builders, for example alkali metal phosphates, which can be in the form of their alkaline, neutral or acidic sodium or potassium salts, are also suitable.

Examples thereof are trisodium phosphate, tetrasodium diphosphate, disodium dihydrogenphosphate, pentasodium triphosphate, "sodium hexametaphosphate", oligomeric trisodium phosphate with amounts of oligomerization in the range from 5 to 1000, in particular 5 to 50, and mixtures of sodium and potassium salts.

The builder substances can be present in amounts of from 5% by weight to 80% by weight, preference being given to a proportion of from 10% by weight to 60% by weight.

The desired viscosity of the compositions can be adjusted by adding water and/or organic solvents or by adding a combination of organic solvents and thickeners.

In principle, suitable organic solvents are all mono- or polyhydric alcohols. Preference is given to using alcohols having 1 to 4 carbon atoms, such as methanol, ethanol, propanol, isopropanol, straight-chain and branched butanol, glycerol and mixtures of said alcohols. Further preferred alcohols are polyethylene glycols having a relative molecular mass below 2000. In particular, the use of polyethylene glycol having a relative molecular mass between 200 and 600 and in amounts of up to 45% by weight, and of polyethylene glycol having a relative molecular mass between 400 and 600 in amounts of from 5 to 25% by weight is preferred. An advantageous mixture of solvents consists of monomeric alcohol, for example ethanol and polyethylene glycol in the ratio 0.5:1 to 1.2:1.

Further suitable solvents are, for example, triacetin (glycerol triacetate) and 1-methoxy-2-propanol.

The thickeners used are preferably hydrogenated castor oil, salts of long-chain fatty acids, preferably in amounts of from 0 to 5% by weight and in particular in amounts of from 0.5 to 2% by weight, for example sodium, potassium, aluminum, magnesium and titanium stearates or the sodium and/or potassium salts of behenic acid, and polysaccharides, in particular xanthan gum, guar guar, agar agar, alginates and Tyloses, carboxymethylcellulose and hydroxyethylcellulose, and also higher molecular weight polyethylene glycol mono- and diesters of fatty acids, polyacrylates, polyvinyl alcohol and polyvinylpyrrolidone, and electrolytes such as sodium chloride and ammonium chloride.

Suitable thickeners are water-soluble polyacrylates which have, for example, been crosslinked with approximately 1% of a polyallyl ether of sucrose, and which have a relative molecular mass above one million. Examples thereof are the polymers obtainable under the name Carbopol® 940 and 941. The crosslinked polyacrylates are used in amounts not exceeding 1% by weight, preferably in amounts of from 0.2 to 0.7% by weight.

Suitable enzymes are those from the class of proteases, such as BLAP, Optimase®, Opticlean®, Maxacal®, Maxapem®, Esperase®, Savinase®, Purifect® OxP and/or Durazym®, lipases, such as Lipolase®, Lipomax®, Lumafast® and/or Lipozym®, amylases, such as Termamyl®, Ainylase®-LT, Maxamyl®, Duramyl® and/or Purafect® OxAm, and cutinases, pullulanases and mixtures thereof. Their proportion can be from 0.2 to 1% by weight. The enzymes can be adsorbed to carrier substances and/or embedded in coating substances.

Possible silver corrosion inhibitors are the compounds given in DE 196 49 375.

As foam regulators, it is possible to add, preferably, up to 6% by weight, in particular about 0.5% by weight to 4% by weight, of foam-suppressing compounds, preferably from the group of silicone oils, mixtures of silicone oil and hydrophobicized silica, paraffins, paraffin/alcohol combinations, hydrophobicized silica, bis-fatty acid amides and other known commercially available antifoams.

To set a desired pH which does not result by mixing the other components by itself, the compositions according to the invention can comprise system- and environmentally-compatible acids, in particular citric acid, acetic acid, tartaric acid, malic acid, lactic acid, glycolic acid, succinic acid, glutaric acid and/or adipic acid, or else mineral acids, in particular sulfuric acid or alkali metal hydrogensulfates or bases, in particular ammonium or alkali metal hydroxides. Such pH regulators are present in the compositions according to the invention in amounts which, preferably, do not exceed 10% by weight, in particular in amounts of from 0.5% by weight to 6% by weight.

Examples of suitable preservatives are phenoxyethanol, formaldehyde solution, pentanediol or sorbic acid.

Suitable pearlizing agents are, for example, glycol distearic esters, such as ethylene glycol distearate, but also fatty acid monoglycol esters.

Suitable salts or extenders are, for example, sodium sulfate, sodium carbonate or sodium silicate (waterglass).

Typical individual examples of further additives which can be mentioned are sodium borate, starch, sucrose, polydextrose, RAED, stilbene compounds, methylcellulose, toluene sulfonate, cumene sulfonate, soaps and silicones.

The bleaching catalysts of this invention can be used in a large number of products. These include textile detergents, textile bleaches, surface cleaners, toilet cleaners, machine dishwashing detergents and also denture cleaners. The detergents can be in solid or liquid form.

For reasons of stability and handlability, it is advantageous to use the bleach activators in the form of granulates which, in addition to the bleaching catalyst, comprise a binder. Various methods of preparing such granulates are described in the patent literature, for example in Canadian Patent No.1 102 966, GB 1 561 333, U.S. Pat. No. 4,087, 369, EP 240 057, EP 241 962, EP 101 634 and EP 62 523. The granulates which comprise the bleaching catalysts according to the invention are generally added to the detergent composition together with the other dry constituents, such as, for example, enzymes, inorganic peroxide bleaches. The detergent composition to which the catalyst granulates are added can be obtained in a variety of ways, such as, for example, mixing the dry components, extruding or spray-drying.

In a further embodiment, the bleaching catalysts according to the invention are particularly suitable for non-aqueous liquid detergents, together with a bleaching peroxide compound. These are compositions in the form of a non-aqueous liquid medium in which a solid phase can be dispersed. The non-aqueous liquid medium can be a liquid, surface-active substance, preferably a nonionic surface-active substance, a nonpolar liquid medium, such as, for example, liquid paraffin, a polar solvent, such as, for example, polyols, for example glycerol, sorbitol, ethylene glycol, possibly in conjunction with low molecular weight monohydric alcohols, such as ethanol or isopropanol or mixtures thereof.

The solid phase can consist of builder substances, alkalis, abrasive substances, polymers and solid ionic surface-active compounds, bleaches, fluorescent substances and other customary solid ingredients.

EXAMPLES

The examples below serve to illustrate the invention in more detail without limiting it thereto.

Example 1

[4-Cascade:ethylenediamine [4]:(1-azabutylidene):2-methinephenol] manganese 5.16 g (43 mmol) of salicylaldehyde were dissolved in a suspension of 100 ml of toluene and 30 g of $Na_2SO_4$. Over a period of 1 h, 3.05 g (10.6 mmol) of 4-cascade:ethylenediamine [4]:3-propylamine suspended beforehand in toluene were added dropwise thereto. The mixture was stirred for a further 24 h at room temperature and then filtered. The solvent was removed under reduced pressure.

1.3 g of the resulting compound (1.84 mmol) were refluxed with 900 mg (3.67 mmol) of manganese diacetate in 50 ml of ethanol for 6 h. The reaction solution was then concentrated by evaporation to about 15 ml, left to stand overnight in a refrigerator, the solvent was completely removed and the residue was taken up with about 10 ml of MeOH. The complex crystallized out of the solution as a brown solid (yield: 1.8 g).

Example 2

[8-Cascade:ethylenediamine [4]:(1-azabutylidene)$^2$:2-methinephenol] manganese 2.2 g (18 mmol) of salicyl aldehyde were dissolved in a suspension of 50 ml of toluene and 15 g of $Na_2SO_4$. Over a period of 1 h, 1.53 g (2.05 mmol) of the octamine ($CH_2N(CH_2CH_2N(CH_2CH_2NH_2)_2)_2)_2$ suspended beforehand in 50 ml of toluene were added dropwise thereto, and the solution turned yellow. The mixture was stirred for a further 24 h at room temperature and then filtered. The solvent was removed under reduced pressure and the high-viscosity yellow residue was washed repeatedly with hot methanol.

2.93 g of the resulting compound (1.86 mmol) in 150 ml of ethanol were firstly treated with 30 ml of 0.5 m KOH and refluxed for 30 min. Manganese diacetate (4.6 g, 18.77 mmol) was then added, and the mixture was refluxed for 45 min and cooled. Following the addition of 0.95 g of LiCl in 7.5 ml of water, the mixture is stirred for a further 45 min at room temperature. The complex crystallizes out of the solution as a brown solid (yield: 3.8 g).

Bleaching Tests

A bleach composition was prepared by mixing an aqueous solution of WMP reference detergent (Wäschereiforschung Krefeld [Krefeld Laundry Research] 2 g/l in water of 15° German hardness), 1 g/l of percarbonate, 0.5 g/l of tetraacetylethylenediamine (TAED) and 10 mg/l of the respective catalyst and/or additionally 0.5 g/l of tetraacetylethylenediamine (TAED). Using this composition, swatches of fabric soiled with the standard soiling curry BC-4 and BC-1-tea (Krefeld Laundry Research) were subjected to a treatment at a temperature of 40° C. under isothermal washing conditions in a Linitest apparatus (Heraeus). After a washing time of 30 minutes, the swatches of fabric were rinsed with water, dried and ironed; the bleaching action was then quantified by determining the differences $\Delta R_{(CAT\text{-}TAED)}$ in reflectances before and after bleaching using an ELREPHO 2000 whiteness measuring instrument (Datacolor). These $\Delta R_{(CAT\text{-}TAED)}$ values and the $\Delta R_{(TAED)}$ values determined in control experiments without bleaching catalyst were used to calculate the$\Delta\Delta R$ values listed in Table 1, which are a direct measure of the improvement in bleaching action brought about by the addition of catalyst:

$$\Delta\Delta R = \Delta R_{(cat\text{-}TAED)} - \Delta R_{(TAED)}$$

TABLE 1

Average values of the differences in reflectance

| Bleach | Tea |
|---|---|
| Mn complex as in Example 2 | 5.0 |
| Mn complex as in Example 2 + TAED | 4.6 |

TABLE 2

The bleaching performance as a function of wash temperature

| Temperature in [° C.] | Reflectance ΔR in [%] WMP + SPC | Catalyst as in Ex. 2 |
|---|---|---|
| 20 | 43.6 | 46.7 |
| 40 | 48.9 | 54.9 |
| 60 | 59.9 | 63.8 |
| 80 | 64.9 | 64.8 |

The experiments were carried out in a Linitest apparatus with a wash time of 30 minutes. The amounts used were 2 g/l of WMP base detergent and 1 g/l of sodium percarbonate (SPC), and 10 mg/l of catalyst as in Example 2. The test fabric used was WFK-BW-tea (BC-1).

At temperatures below 80° C. the bleaching performance of the catalyst-containing detergent is higher than without catalyst.

TABLE 3

The bleaching action as a function of pH

| pH | Reflectance ΔR in [%] |
|---|---|
| 7 | 42.2 |
| 8 | 41.8 |
| 9 | 41.7 |
| 10 | 43.2 |
| 11 | 50.7 |
| 12 | 47.3 |

The experiments were carried out in a Linitest apparatus with a wash time of 30 minutes and at a wash temperature of 23° C. The amounts used were 2 g/l of WMP base detergent and 0.5 g/l of sodium perborate monohydrate, and 10 mg/l of catalyst as in Example 2. The test fabric used was WFK-BW-tea (BC-1).

The pH optimum was reached at 11. The compound tested is therefore suitable for use in standard commercial laundry detergents.

TABLE 4

Color damage from the bleaching catalyst according to the invention compared with other laundry detergent formulations

| Laundry detergent | Reflectance ΔR in [%] Brilliant Red GG | Remazol Black B. |
|---|---|---|
| WMP + SPC | 30.8 | 9.5 |
| Cat. as in Ex. 2 | 31 | 9.5 |
| Mn triazacyclononane | 39.5 | 22.4 |

The experiments were carried out in a Linitest apparatus with a wash time of 30 minutes. The amounts used were 2 g/l of WMP base detergent and 1 g/l of sodium percarbonate, and 10 mg/l of catalyst. The test fabric used was cotton with Brilliant Red GG and Remazol Black B as dye.

The manganese dendrimer complex according to the invention, accordingly, causes only slight color damage, similar to the catalyst-free detergent.

TABLE 5

Fiber damage from the bleaching catalyst according to the invention compared with other laundry detergent formulations

| Laundry detergent | Degree of depolymerization (DP) |
|---|---|
| WMP/SPC/TAED | 1904 |
| +Mn triazacyclononane | 506 |
| Mn Complex as in Ex. 2 | 1490 |

The degree of depolymerization (DP) of cotton is given as a measure of the fiber damage. In the absence of catalyst, DP values around 2000 are found. These correspond to low fiber damage. Lower values indicate greater fiber damage. Table 5 shows the DP values of catalyst-containing laundry detergent formulations compared with catalyst-free base detergents. To determine the DP values, washing was carried out five times in a catalyst concentration of 2000 ppm.

What is claimed is:

1. A laundry detergent comprising a peroxy compound and a compound of the formula $$(R^1R^1)N—X—N(R^1R^1) \quad (I)$$

or metal complexes thereof with transition metals, in which $R^1$ is a group of the formula $(R^2R^3)N—(CH_2)_n—$, $R^2$ and $R^3$ are in each case a group of the formula $(R^4R^5)N—(CH_2)_n—$, n is the numbers 2 or 3, or $R^2$ and $R^3$ together are the group of the formula A or $R^2$ is hydrogen and $R^3$ is a group of the formula

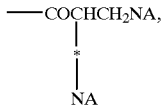

$R^4$ and $R^5$ are in each case a group of the formula $(R^6R^7)—N—(CH_2)_n—$, n is the numbers 2 or 3, or $R^4$ and $R^5$ together are the group of the formula A or $R^4$ is hydrogen and $R^5$ is a group of the formula

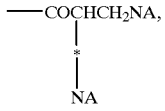

$R^6$ and $R^7$ are in each case a group of the formula $(R^8R^9)N—(CH_2)_n—$, n is the numbers 2 or 3, or $R^6$ and $R^7$ together are the group of the formula A or $R^6$ is hydrogen and $R^7$ is a group of the formula

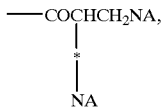

$R^8$ and $R^9$ together are the group of the formula A or $R^8$ is hydrogen and $R^9$ is a group of the formula

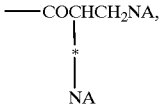

A is a group of the formula

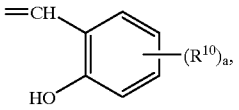

in which a is an integer from 1 to 4, and $R^{10}$ is hydrogen, $C_1$–$C_{30}$-alkyl, cycloalkyl or aryl radicals, $C_1$–$C_4$-alkoxy groups, substituted or unsubstituted amino or ammonium groups, halogen atoms, sulfo groups, carboxyl groups or groups of the formula —$(CH_2)_r$—COOH, —$(CH_2)_r$—$SO_3H$, —$(CH_2)_r$—$PO_3H_2$, —$(CH_2)_r$—OH, where r is an integer from 0 to 4, and said acid groups may also be present in salt form, and X is a group of the formulae —$(CH_2)_n$—, —$(CH_2)_3$—$NR^{11}$—$(CH_2)_3$—, —$(CH_2)_2$—$NR^{11}$—$(CH_2)_2$—, $C_2$–$C_{20}$-alkylene, —$(CH_2)_l$—[O—$(CH_2)_k]_m$—O—$CH_2)_l$)—, n is a number from 2 to 20, l and k are a number from 2 to 6, m is a number from 1 to 40, $R^{11}$ is $C_1$–$C_{20}$-alkyl, $C_2$–$C_{20}$-dialkylamino-$C_2$–$C_{10}$-alkyl, $C_1$–$C_{10}$-alkoxy-$C_2$–$C_{10}$-alkyl, $C_2$–$C_{20}$-hydroxyalkyl, $C_3$–$C_{12}$-cycloalkyl, $C_4$–$C_{20}$-cycloalkyl-alkyl, $C_2$–$C_{20}$-alkenyl, $C_4$–$C_{30}$-dialkylamino-alkenyl, $C_3$–$C_{30}$-alkoxyalkenyl, $C_3$–$C_{20}$-hydroxyalkenyl, $C_5$–$C_{20}$-cycloalkyl-alkenyl, aryl or $C_7$–$C_{20}$-aralkyl, which are unsubstituted or substituted by $C_1$–$C_8$-alkyl, $C_2$–$C_8$-dialkylamino, $C_1$–$C_6$, alkoxy, hydroxy, $C_3$–$C_8$-cycloalkyl, $C_4$–$C_{12}$-cycloalkylalkyl, or two of these substitutents may form together an alkylene chain optionally interrupted by nitrogen or oxygen.

2. The laundry detergent as claimed in claim 1, which comprises complexes of the compounds of the formula I with Co, Mn, Fe, Ru, V, Mo or W.

3. The laundry detergent as claimed in claim 1, which comprises complexes of the formula I with Mn.

4. The laundry detergent as claimed in claim 1, where X is a group of the formula —$(CH_2)_n$— and n is a number from 2 to 20.

5. The laundry detergent as claimed in claim 1, which comprises a compound of the formula I or metal complexes thereof in an amount of from 0.0001 to 0.5% by weight, based on the total amount of laundry detergent.

6. The laundry detergent as claimed in claim 1 wherein, with respect to $R^{11}$, said alkylene chain optionally interrupted by nitrogen or oxygen is selected from the group consisting of ethylene oxide, propylene oxide, butylene oxide and —$CH_2CH(CH_3)$—O—.

* * * * *